United States Patent [19]

Green

[11] 4,336,699

[45] Jun. 29, 1982

[54] SYSTEM FOR INTERLOCKING OBJECTS

[76] Inventor: Robert D. Green, 423 University Village, Salt Lake City, Utah 84108

[21] Appl. No.: 91,047

[22] Filed: Nov. 5, 1979

[51] Int. Cl.[3] ..... E05B 37/20; A63H 9/00

[52] U.S. Cl. ..... 70/290; 273/153 S

[58] Field of Search ..... 70/289, 290, 288, 287, 70/276, 413; 273/153 R, 153 P, 153 S, 157 R

[56] References Cited

U.S. PATENT DOCUMENTS 527,925 10/1894 Bartholomew ..... 70/289

3,684,292 8/1972 Penrod ..... 70/289

OTHER PUBLICATIONS

*Popular Science*—Prof. A. M. Low-Wizard's Boxes, Mar. 1953, pp. 188-191.

*Primary Examiner*—Robert L. Wolfe

*Attorney, Agent, or Firm*—Thorpe, North, Western & Gold

[57] ABSTRACT

A system and method of interlocking objects by the use of locking and blocking pins that longitudinally move through channels when an external directional force field is longitudinally aligned with and applied to the channels inside of which the pins are located. The channels are self-contained within the objects, with at least a portion of one channel extending from one object to the other. The two objects become interlocked, at least with respect to lateral movement, when a locking pin is positioned in these channels so as to simultaneously extend from one object into the other. Removal of this locking pin, and hence the unlocking of the objects, may be preconditioned on the prior movement of other blocking pins in other intersecting channels selectively positioned so as to block the movement of the locking pin or of each other. Hence, a unique sequence of directional forces selectively applied to the locked objects may be required to unlock the objects. For small hand-held objects that can be easily rotated, the directional force field may be gravity. A preferred embodiment incorporates a pyramid puzzle in which a drawer may be pulled therefrom only after the pyramid has been rotated and tilted according to a set pattern.

7 Claims, 10 Drawing Figures

SYSTEM FOR INTERLOCKING OBJECTS

BACKGROUND OF THE INVENTION

This invention relates to a locking system used to secure two or more detachable objects to each other, and more particularly to a pin-locking system and method that is easily adapted to interlock relatively small objects, such as detachable parts of a hand-held puzzle, jewelry box, chain/cable lock, and the like.

Locking devices have existed since time immemorial not only to secure objects from theft and other unauthorized use, but also to challenge a user, as in an interlocking puzzle, to discover and use the locking principle upon which the device operates. All locking devices that are used to secure one detachable object to another, including that of the present invention, implement a primary locking mechanism, such as a latch or rod, that physically holds the two objects in their locked condition.

To detach or unlock the objects, some force must be used to physically move this latch or rod so as to allow one object to be detached from the other. This force is typically provided by the user of the lock, such as through the turning of a key or handle, thus necessitating the use of additional moving parts other than the primarily locking mechanism. More sophisticated locks condition the application of this force upon the correct completion of a set sequence of events. That is, the locking latch or rod may be physically constrained from being moved until a set of tumblers have fallen into a unique configuration, or a set of buttons have been pushed in a set sequence. As the sophistication of these kinds of locks increases, "sophistication" referring to the number of steps that must be performed before the lock may be opened, the number of moving parts used in the lock, as well as their cost of manufacture and maintenance, increases accordingly. Thus, a definite need exists for a "sophisticated," yet simple to manufacture locking device that can be used not only to securely lock objects together, but also to challenge, entertain, and amuse the users thereof.

SUMMARY OF THE INVENTION

A primary object of the present invention is to provide an inexpensive, reliable, yet potentially sophisticated, locking system that can be used to secure two or more objects to each other.

A further object of the present invention is to provide such a locking system that has a minimum of moving parts.

A still further object of the present invention is to provide such a locking system that is totally self-contained, the user thereof not having to insert keys, turn handles, or in any way come in contact with the moving parts within the device.

Another object of the present invention is to provide a locking system that lends itself to increased sophistication without significantly increased manufacturing or maintenance costs.

Still another object of the present invention is to provide an inexpensive, reliable, easy-to-manufacture locking system that may be implemented in puzzles and similar devices so as to provide a significant challenge, as well as hours of entertainment and amusement, to both user and observer alike.

These and other objects of the present invention are realized in a locking system characterized by the lack of key holes, dials, or other moving parts with which a user must interface. The locking function is achieved by a network, or maze, of channels located within at least one of the interlocking objects. Inside each channel a rigid pin is placed. The width of this pin is slightly smaller than the width of the channel so that the pin freely moves longitudinally through the channel while at the same time being restricted with respect to any significant lateral movement. The channels are designed so that at least one extends into the other interlocking object. Thus, when a rigid pin is positioned in such a channel so that it simultaneously extends into both objects, lateral movement between the two objects is prevented. When the two objects are configured so that lateral movement is the only possible movement between them, such as a drawer (first object) which must be laterally slid out of a frame (second object), then the pin serves to lock the two objects together.

Different degrees of sophistication, that is, the number of steps required to "unlock" the objects that are secured together, may be easily added to the locking system of the present invention by merely providing additional channels (inside of which are located corresponding pins) that intersect with the existing channels. The intersection of the channels is designed so that movement of a first pin, i.e., the one that unlocks the objects, is conditioned on the prior movement of a second pin. In turn, the movement of the second pin may be conditioned on the prior movement of a third pin, which may likewise be conditioned on the prior movement of a fourth pin, and so on.

A pin is moved by subjecting it to an external directional force field, such as a magnetic, centrifugal or gravitational force field. Thus, the channels and the pins located therein may be totally self-contained within one or more of the interlocking objects, and the user need never see them or touch them except through the indirect means of gravity, magnetism, centrifugation or the like. In order to move the pins in the proper sequence, the force field must be likewise applied to the objects in the proper sequence and direction. For example, if a gravitational force field is used, the interlocking objects must be rotated in the proper sequence before the objects may be detached.

When a gravitational force field is employed, the present invention is ideally suited for hand-held, easily rotatable, interlocked objects, such as puzzles, drawers or lids of jewelry or novelty boxes, and the like. Moreover, the mystic of being able to detach two hand-held objects only when they are rotated in a set sequence, there being no moving parts or external latches visible, adds challenge, excitement, and enjoyment to both user and observer alike.

BRIEF DESCRIPTION OF THE DRAWINGS

The above and other objects, features, and advantages of the present invention will become apparent from a consideration of the following detailed description presented in connection with the accompanying drawings, in which.

DESCRIPTION OF THE PREFERRED EMBODIMENTS

Figure 1:
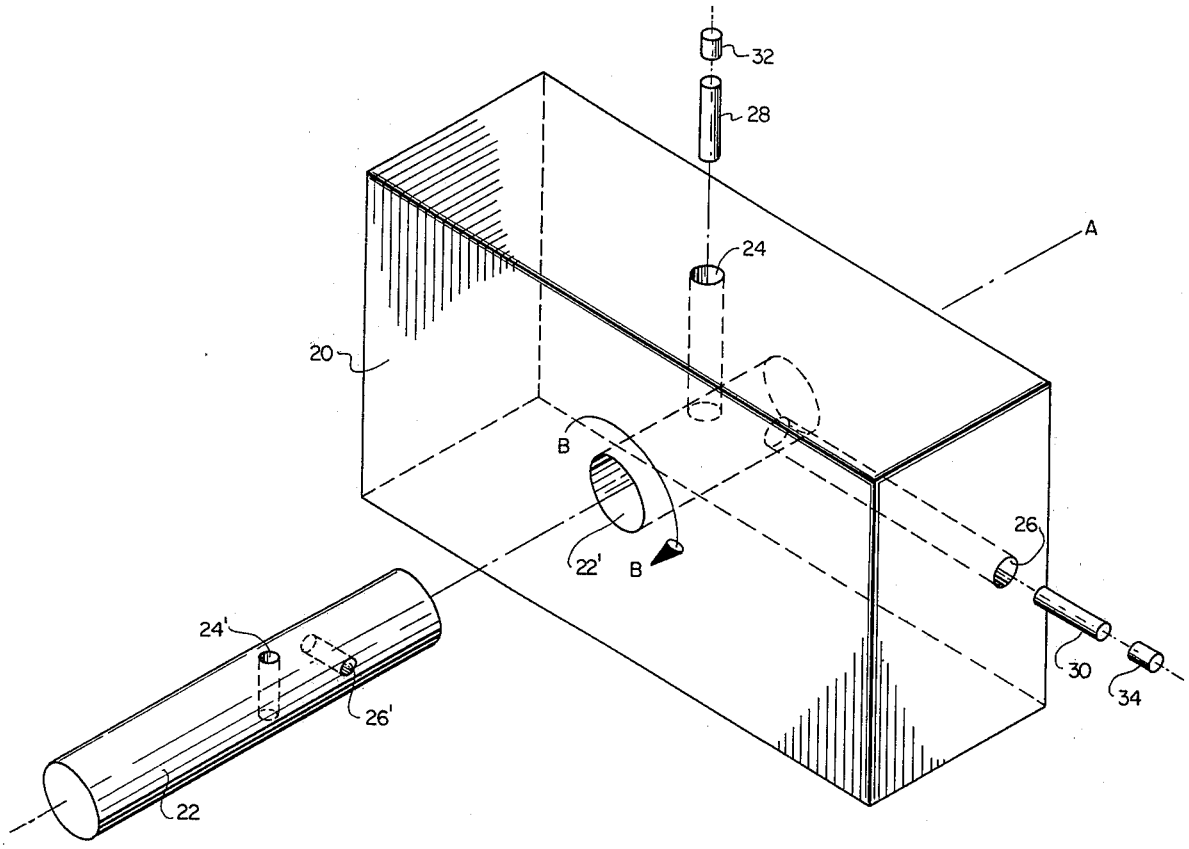
FIG. 1 is a perspective view of a block and rod adapted to be interlocked by a very simple embodiment of the present invention.

In the drawings, there is shown in FIG. 1 a very simple embodiment of the present invention. FIG. 1 depicts a perspective view of a block 20, a first object, into which a large rod 22, a second object may be inserted along the A—A axis. A vertical channel or tunnel 24 and a horizontal channel or tunnel 26 are drilled through the block 20 so as to intersect with the larger channel 22′ into which the large rod 22 is inserted. An extension of the vertical channel 24′ and the horizontal channel 26′ is also drilled through or into the rod 22. Rigid locking pins or rods 28 and 30 are inserted respectively into the vertical channel 24 and the horizontal channel 26. These locking pins or rods may be either solid or hollow, and may be made of any rigid material. They need not be cylindrical in shape, although that is the shape depicted in the preferred embodiment herein disclosed. Also, for purposes of this application, the terms rod and pin will be used synonymously, as will the terms channel and tunnel. The diameters or widths of the locking pins 28 and 30 are slightly less than the inside diameters or widths of the respective channels 24 and 26 into which they are placed, thus allowing the pins to move freely through the channels. The length of the pins is roughly twice that of the diameter of the rod 22.

Once a pin is inserted into a channel, stoppers or caps 32 and 34 are inserted in the channels or tunnels 24 and 26 respectively to confine the locking rods or pins therewithin. The stoppers 32 and 34 are designed not only to confine the locking pins within the channels, but also to conceal the presence of the channels 24 and 26. If a mold-type manufacturing technique is used to mold the block 22 in two or more portions which are subsequently glued together, then the channels 24 and 26 could be premolded and included within the block without the need for drilling or using stoppers or caps.

The free length of the channels 24 and 26, that is the length through which the locking pins may freely move, must be at least 1½ times the length of the pins for the embodiment shown in FIG. 1.

To insert and lock the rod 22 (a first object) into the block 20 (a second object) the locking pins 28 and 30 must first be moved so as not to block the channel 22′. This may be easily done by using the force of gravity, for example, to move the pins out of the channel 22′. All that need be done is to rotate the block 20 180° clockwise (as viewed from the "FRONT") about the axis A—A, as indicated by the arrow B—B. While still in this position, the rod 22 may then be slid into the channel 22′. To lock the rod 22 into this position, the extension channels 24′ and 26′ must be aligned with the channels 24 and 26. This could be done by sliding and rotating the large rod 22 to a marked position, or the rod 22 and channel 22′ could be keyed so that the large rod could only be inserted with the proper alignment. In any event, once the rod 22 has been inserted and aligned in the channel 22′, it can be locked therein by merely moving at least one of the locking pins 28 or 30 so that it extends into its corresponding extension channel 24′ or 26′. This movement can again be easily accomplished through a gravity force by merely continuing to rotate the block 20 about the A—A axis in a clockwise direction back to the position shown in FIG. 1. That is, as soon as the block 20 is rotated 90° clockwise from the position where the rod 22 was inserted and aligned (270° clockwise from that shown in FIG. 1), the gravity force will pull the locking pin 30 through the channel 26 and into the extension channel 26′. Because the locking pin 30 has a length that is roughly twice the diameter of the rod 22, and assuming the extension channel 26′ extends completely through the rod 22, the locking pin 30 will thus be inserted halfway into the rod 22 and halfway into the block 22. In this position, the rod 22 is securely "locked" to the block 20 in that it cannot be pushed or pulled through the channel 22′ nor can it be rotated therewithin.

As the block 20 is rotated back to its original position (180° clockwise from that where the rod 22 was inserted, or 360° clockwise from that shown in FIG. 1), the gravity force will also pull the locking pin or rod 28 through the channel 24 and into the extension channel 24′, thus serving to lock the large rod 22 to the block 20 in the same fashion as occurred with locking rod 30. To unlock, or release the large rod 22, the block must again be rotated 180° clockwise as was done to clear the channel 22′ prior to insertion of the rod, as discussed above.

Note that the gravity force which moves the locking pin 28 into its locking position, for example, will have no affect on the position of the other locking rod 26. This is because at the time (or at the rotation position) the gravity force is pulling locking pin 28 down the channel into its locking position, it is also pulling locking pin 30 laterally against the side of the channel 26. But because lateral movement of the pin within a channel is limited due to the dimensions of the diameters involved, there is no significant pin movement, and the position of locking pin 30 is unchanged. Hence, where the pin channels are orthoginal as in the embodiment of FIG. 1, rod movement is only possible within channels that longitudinally line up, or at least approximately line up, with an external force field.

By selectively placing orthoginal channels, therefore, a design can be configured where only a desired number of pins move on a given exposure to an external force field. Moreover, by carefully manufacturing the diameters of the channels and pins, and by selectively choosing the materials that affect the coefficient of friction between the pin and the channel wall, pin movement may be made highly sensitive to the field alignment with respect to the channel direction. That is, designs are possible, for example, wherein the external force field must be aligned to within plus or minus 15° of the channel direction before pin or rod movement may occur. Thus, pin channels may be arranged at other than orthogional relationships, yet the capability of selective pin movement may still be maintained. The possible levels of sophistication that flow from such a selective system are thus greatly increased.

FIG. 1, as mentioned, describes a very simple embodiment of the present invention. The only level of sophistication incorporated therein is the use of two primary locking pins, pins 28 and 30. Both pins directly interface between the two interlocking objects, and both must be moved before the rod 22 and the block 20 can be unlocked, or separated. For this reason, the pins are specifically termed "locking pins."

Figure 2:
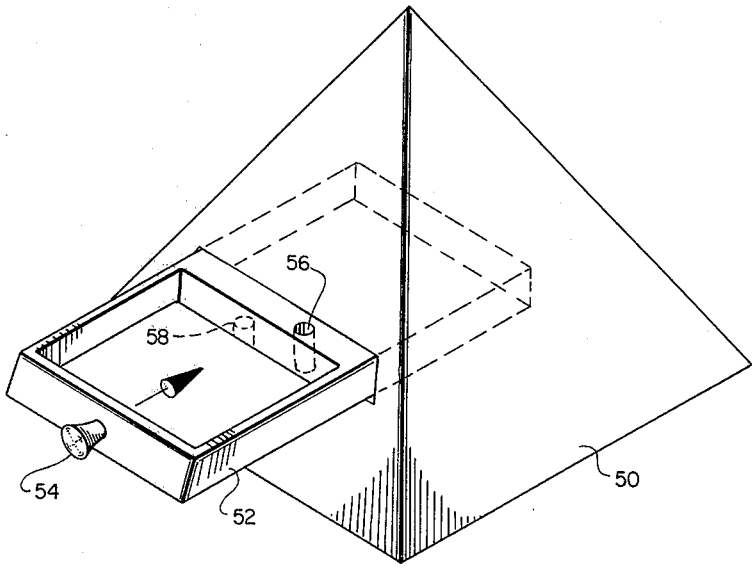
FIG. 2 is a perspective view of a pyramid puzzle in which the pin-locking system of the present invention is used to lock or release a drawer that slides in or out from one side of the pyramid.

In FIG. 2 there is shown a perspective view of an even more sophisticated embodiment of the present invention utilizing a pyramid structure 50 from which a drawer 52 may be pulled (if the proper sequence of forces is first applied. As shown in connection with FIG. 2, the drawer 52 includes a handle 54, and extensions of channels or tunnels 56 and 58 into which pins may fall in order to lock the drawer closed.

Figure 3B:
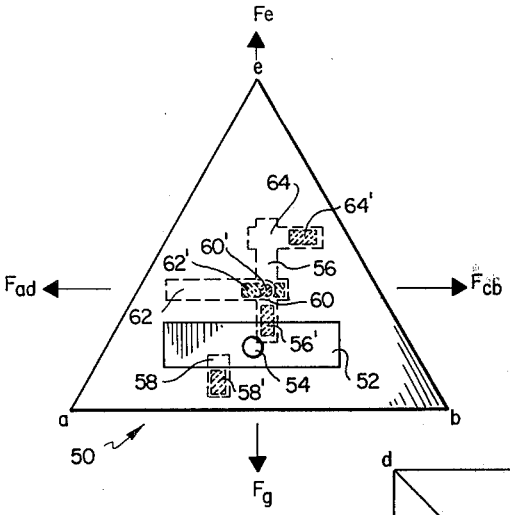
FIGS. 3A, 3B, and 3C show respectively a top view, a front view, and a side view of the pyramid puzzle of FIG. 2, showing the detail of how a fairly sophisticated embodiment of the present invention is implemented, and further illustrating internal pins and drawer in a locked position.
Figure 3C:
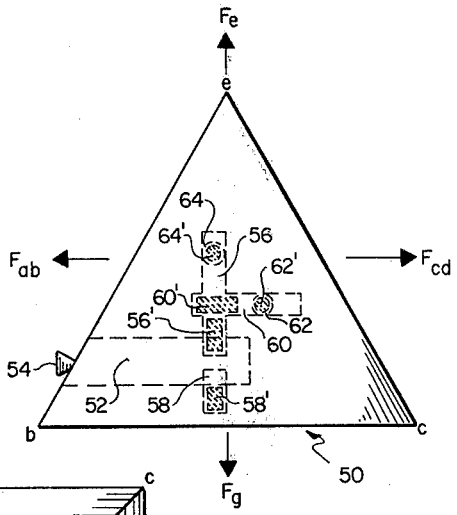
Figure 3A:
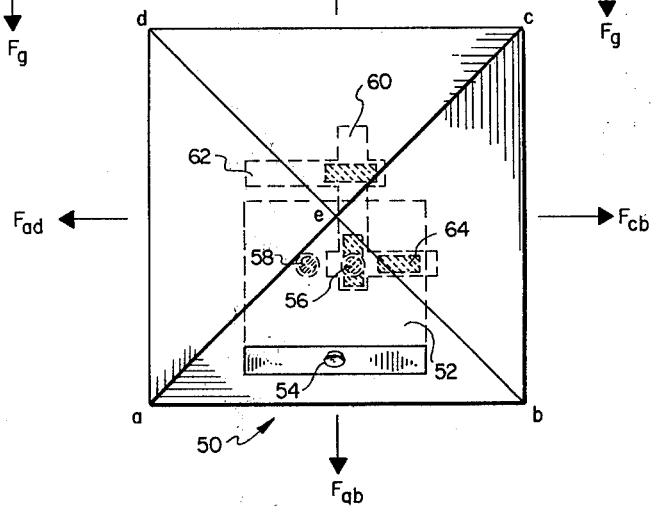

FIGS. 3A, 3B, and 3C show top, front (the front being defined as the side from which the drawer opens) and side views respectively of the embodiment of FIG. 2, illustrating the relationship of the various channels used therein, as well as the location of the corresponding pins required to lock the drawer 52 in its closed position.

As shown in FIGS. 3A, 3B, and 3C, this particular embodiment incorporates two vertical locking channels or tunnels 56 and 58. Channel 56 extends into the top rear portion of the drawer 52, while channel 58 extends into the bottom rear portion. Also incorporated as part of this invention are three horizontal blocking channels or tunnels 60, 62 and 64. Each channel or tunnel has a corresponding pin or rod, 56', 58', 60', 62', and 64' associated therewith. Pins 56' and 59' are the "locking" pins or rods and pins 60', 62', and 64' are the "blocking" pins or rods. Both the blocking and locking pins typically have a length that is approximately five times their diameter. Channel 60 extends rewardly from the front side of the pyramid 50, side "abe" (see FIG. 3A for key to labeling of sides), and a front end thereof intersects with vertical channel 56 at a point greater than one pin length above the bottom of channel 56. Channel 62 runs perpendicular to channel 60, parallel to the front of the pyramid 50, and intersects channel 60 at a point greater than one pin length from the end of channel 60 that intersects with vertical channel 56. Channel 64 also runs parallel to the front of the pyramid 50 but one end thereof intersects with vertical channel 56 at a point above its intersection with channel 60. FIGS. 3A, 3B, and 3C also show the direction of the various force fields that could be applied to the pyramid 50. These are labeled $F_{ab}$, $F_{cb}$, $F_{cd}$, $F_{ad}$, $F_e$ and $F_g$, and are represented as arrows in the figures.

Figure 4B:
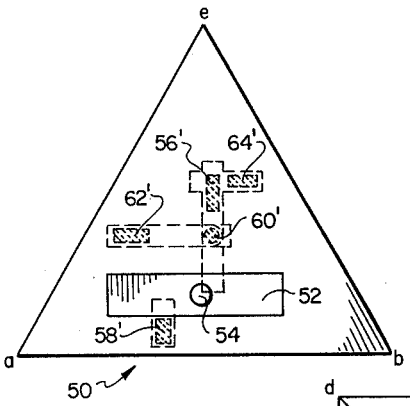
FIGS. 4A, 4B, and 4C are the same as FIGS. 3A, 3B, and 3C except that the internal pins are shown in the unlocked position.
Figure 4C:
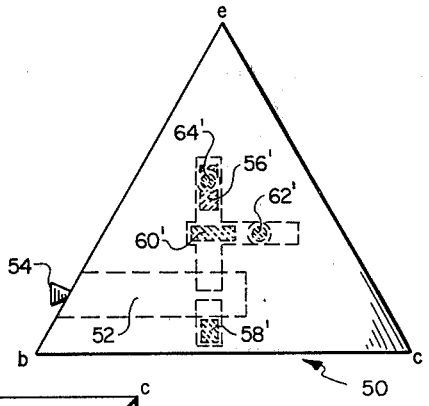
Figure 4A:
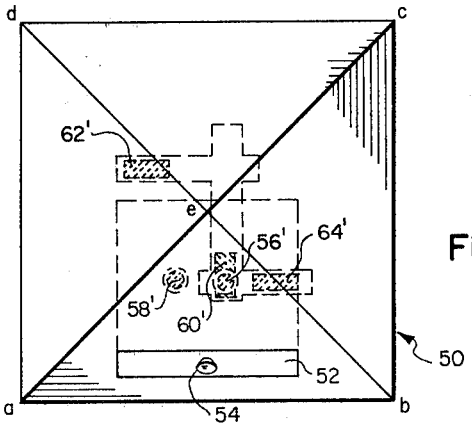
Figure 5:
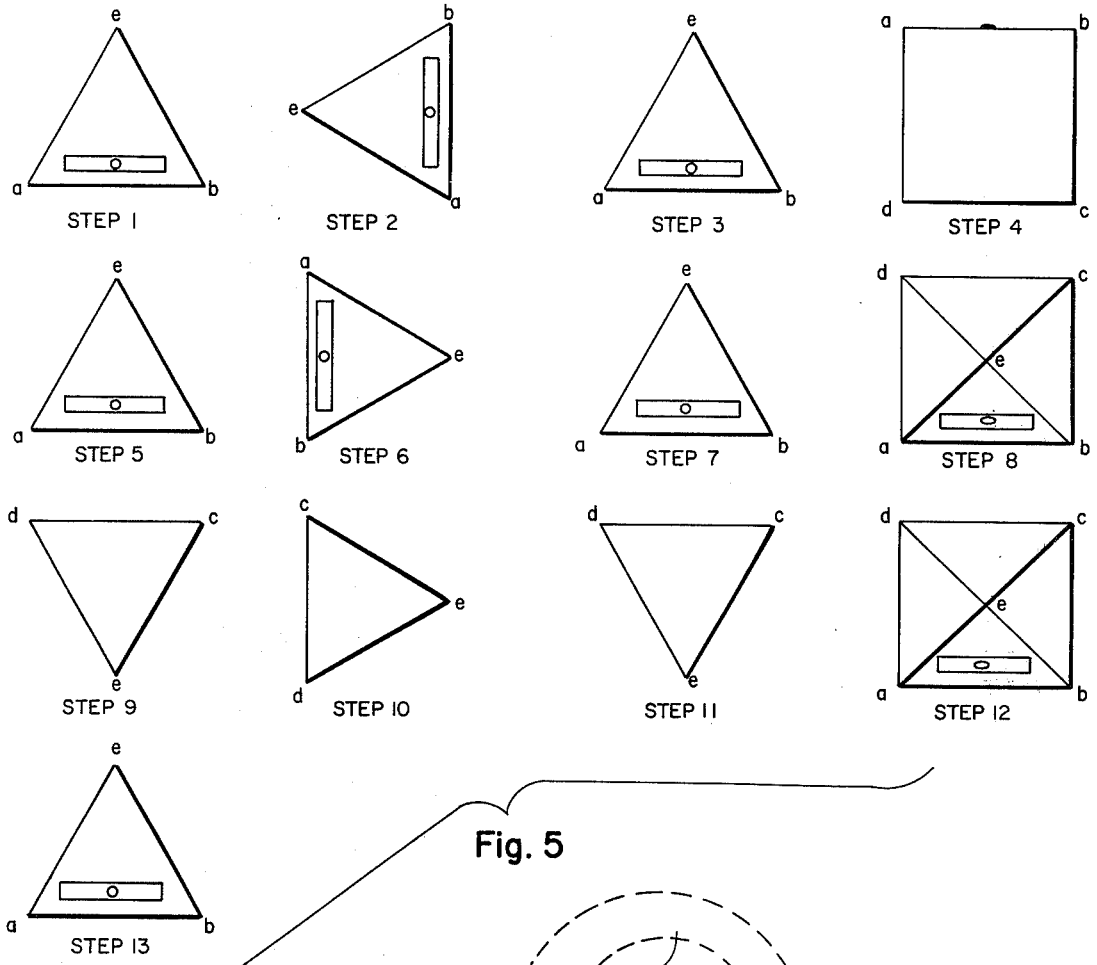
FIG. 5 is a sequence diagram indicating a sequence of steps that may be taken to use a gravitational force field to unlock the embodiment of the invention shown in FIGS. 3A-3C.

FIGS. 4A, 4B, and 4C show the same elements as are shown in FIGS. 3A, 3B and 3C, except that the pins or rods 56', 58', 60', 62', and 64' are shown in their unlocked position. FIG. 5 is a sequence diagram indicating a sequence of rotations that could be applied to the pyramid embodiment presently under discussion in order to have gravity forces act upon the pins in the proper sequence. In other words, FIG. 5 shows a sequence of steps that uses gravity forces to move the pins from their "locked position" shown in FIGS. 3A, 3B, and 3C to their "unlocked position" of FIGS. 4A, 4B, and 4C. Each of these steps will now be explained.

In FIG. 5, Step 1, the pyramid is upright and a force $F_g$ holds locking pin 56' in its locked position (FIGS. 3B, 3C). A force $F_{ad}$ is applied by tilting the pyramid as shown in Step 2 (FIG. 5), which force pulls blocking pins 62' and 64' to the left end of their respective channels (FIG. 3B). By moving blocking pin 62' in this fashion, tunnel 60 is thus opened up so that locking pin 60' may be moved from its blocking position above pin 56'. Blocking pin 60' is moved to the rear end of its channel 60 by applying a force $F_{cd}$ (FIG. 3C). In order to preserve the locations of pins in the various channels, while this is done, and to control the direction of the gravity forces that influence the pins, this force should be applied by first uprighting the pyramid as shown in Step 3 (FIG. 5). This uprighting merely applies the force $F_g$ and does not change any pin locations. Then, as shown in Step 4, a force $F_{cd}$ (FIG. 3A) is applied by tilting the pyramid backwards. This force pulls blocking pin 60' to the rear of channel 60, thus setting the stage for moving locking pin 56' out of its locking position.

Before locking pin 56' can be moved, however, blocking pin 64' must also be moved to completely clear channel 56. Recall that blocking pin 64' was pulled to the left of channel 64, thereby blocking channel 56, during Step 2 (FIG. 5). To move blocking pin 64' back to the right end of tunnel 64, a force $F_{cb}$ (FIG. 3B) must be applied. This is done by first uprighting the pyramid (Step 5 of FIG. 5), and then tilting the pyramid as shown in Step 6 of FIG. 5. This force will also move blocking pin 62' to the right side of channel 62 (FIG. 3B), but this is of no consequence at this point because channel 62 does not intersect vertical locking channel 56, which is the channel that needs to be opened in order for the locking pin 56' to be moved. Moreover, as will be seen below, this placement of blocking pin 62' prevents blocking pin 60' from sliding down channel 60 so as to block channel 56.

After force $F_{cb}$ is applied by tilting the pyramid as shown in Step 6 (FIG. 5), the pyramid may again be uprighted as shown in Step 7. Channel 56 is now open, and locking pin 56' may be disengaged from its locking position by applying a force $F_e$ to move it to the upper end of channel 56. To apply a force $F_e$, the pyramid must be tipped up-side-down. This is done in two steps, as shown in Steps 8 and 9 of FIG. 5. Step 8 applies a force $F_{ab}$ which does not significantly change the location of any pins. Actually, the only pin that could be affected by this force, i.e., the only pin in a channel that is lined up with the direction of the force $F_{ab}$, is blocking pin 60'. As mentioned above, however, the placement of blocking pin 62' at the right end of channel 62 during Step 6 blocks blocking pin 60' from any movement that it might otherwise make. Step 9 applies a force $F_e$, and the locking pin 56' is pulled to the upper end of channel 56, thus unlocking the upper side of the drawer 52. However, at the same time this upper side is unlocked, the lower side is locked by the action of locking pin 58', which is also pulled by the force $F_e$ to the upper, or locking, end of its channel 58.

In Step 10, a force $F_{ad}$ (FIG. 3B) is applied by tilting the pyramid as shown. This force pulls blocking pin 62' to the left side of its channel 62, and also tries to pull blocking pin 64' to the left side of its tunnel 64. However, locking pin 56', still at the upper end of its channel 56, blocks any significant movement of pin 64'.

To hold locking pin 56' to the upper end of its channel 56, blocking pin 60' must be moved back to the front end of its channel. This is accomplished by applying a force $F_{ab}$ (FIG. 3C). To apply this force, the pyramid is first tipped up-side-down (Step 11), thus applying a force $F_e$ that preserves the locations of all the pins, and then tipped as shown in Step 12.

Finally, the pyramid may be uprighted as shown in Step 13. This applies a force $F_g$ which moves locking rod 58' back to the bottom of its channel 58, thus unlocking the bottom portion of the drawer 52. The upper portion remains unlocked because locking pin 56' is blocked from falling into its locking position by blocking pin 60'. The location of all the pins is now as shown in FIGS. 4A, 4B, and 4C, and the drawer may be pulled or extended from the pyramid as shown in FIG. 2.

To lock the drawer, all that need be done is to close the drawer, tilt the pyramid back (as in Step 4 of FIG. 5) so that a force $F_{cd}$ will move blocking rod 60' back to the rear of its tunnel, thereby allowing locking pin 56' to fall back into its locking position when the pyramid is uprighted.

Figure 6:
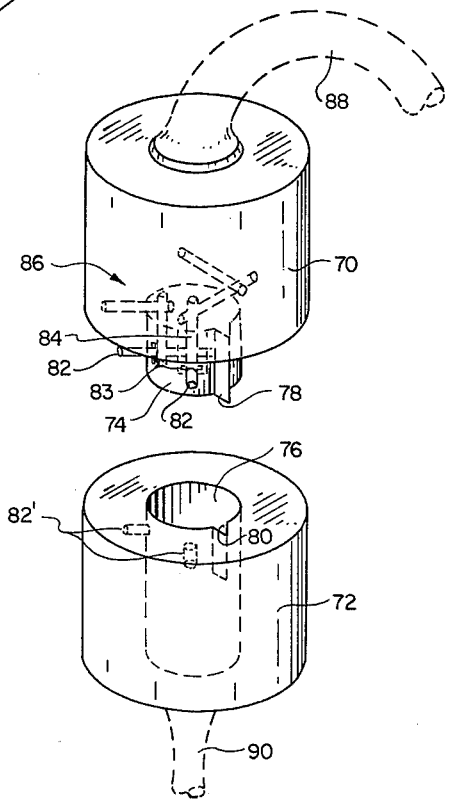
FIG. 6 illustrates a different application of the present invention used for interlocking a pair of plug/receptacle type objects, one adapted to be inserted into the other.

FIG. 6 depicts a perspective view of a different embodiment of the present invention used to lock a pair of plug and receptacle type objects together. In FIG. 6, the objects are shown as cylindrical in shape, but any geometrical shape could be used. A first object 70 is adapted to interface with a second object 72. The first object 70 includes at least one large finger-like extension 74 that is inserted into a corresponding cavity section 76 of the second object 72. A keying flange 78, and corresponding keying grove 80, are provided so that the first and second objects may only be joined in one particular alignment. Locking pins 82 protrude radially from channels 84 located within the finger 74 and, when the first object 70 and second object 72 are pushed together, extend into channels 82' located on the inside wall of the cavity 76. With the pins 82 thus engaged, the first and second objects are firmly interlocked, and may not be separated. Each locking pin 82 has associated therewith keeper flanges 83 to prevent the locking pins from falling out of their channels 84 when the first and second objects are not engaged together. Locking channels 84 are appropriately shaped to allow the locking pins 82, including the flanges 83, to longitudinally slide therein. A network of channels, shown generally at 86, each with corresponding blocking pins located therein, intersects the channels 82 or each other in such a fashion that a locking system results according to the manner and method of the invention taught herein. The first object 70 may only be removed from the second object 72 when the locked unit has been exposed to the proper sequence of directional force fields. These directional fields could be generated by applying magnets in a proper sequence at different locations around the unit (assuming the pins in each channel are made of ferrous material) or by rotating and tipping the unit in a proper sequence thereby selectively subjecting each pin in each channel to a gravitational field. Or, a centrifugal force field could be applied to selectively move the pins by spinning the objects about various axes. Ends of a chain or cable 88 could be affixed to the first object 70 and ends of another cable or chair 90 could be affixed to the second object 72 so that the locking together of the objects 70 and 72 serves to lock the chain or cable 88 to the chain or cable 90. Alternatively, one end of a single chain or cable 88 could be attached to the first object 70, and the other end of the same chain or cable 88 could be affixed to the second object 72, thereby forming a continuous loop cable lock that could be used for a variety of applications, such as a bicycle lock, necklace, or the like.

More sophisticated embodiments of the invention include locking channels in both of the objects to be joined together, as well as a network or maze of blocking channels in each object to condition the prior movement of locking or blocking pins.

As mentioned above, in addition to a gravitational force field, magnetic or centrifial forces could be used to selectively move the locking and blocking pins. Alternatively, appropriate openings could be made into the various channels to allow the use of compressed air and/or fluids to enter therein to position the pins. Even electrostatic forces could be selectively applied to move the pins in the desired sequence, much as a solenoid moves a pin between two locations.

It is to be understood that the above described arrangements are only illustrative of the application of the principles of the present invention. Numerous other modifications and alternative arrangements may be devised without departing from the spirit and scope of the present invention and the appended claims are intended to cover such modifications and arrangements.

I claim:

1. A system for interlocking objects comprising:

a polyhedron, adapted to be hand held, including:

a first locking channel located therein, one end of said locking channel originating at a surface of said polyhedron, and at least one enclosed blocking channel, each blocking channel having a blocking pin inserted therein, each blocking channel originating and terminating within said polyhedron, and each channel orthogonally intersecting at least one other channel within said polyhedron, at least one blocking channel orthogonally intersecting said locking channel;

a drawer adapted to be inserted into said polyhedron such that the surface of said polyhedron where said first locking channel originates is adjacent to a surface of said drawer in which a second locking channel originates, said second locking channel being aligned with said first locking channel so that one serves as an extension of the other when said drawer is inserted into said polyhedron;

a locking pin inserted into one of said locking channels, said pin being dimensioned such that it may freely move longitudinally within said locking channels but may not move laterally therewithin; and indirect force means for selectively moving said locking and blocking pins longitudinally within their respective locking and blocking channels, said force means making no direct physical contact with said pins, thereby allowing said locking pin to be positioned within said locking channels so that it simultaneously extends part way into said polyhedron and part way into said drawer when said drawer is inserted into said polyhedron and said locking channels are aligned, thus locking all lateral movement between the surfaces of said drawer and polyhedron, and thereby further allowing said blocking pins to be selectively positioned at the intersections of said channels, each of said blocking pins thus serving to block the movement of the locking or blocking pins within their respective channels.

2. A system for interlocking objects as defined in claim 1 wherein said polyhedron is a pyramid.

3. A system for interlocking objects comprising:

a first object, at least a portion of which is adapted to be inserted into a second object, said first object including:

a first locking channel located therein, one end of said locking channel originating at the surface of said first object that is adapted to be inserted into the second object, and at least one enclosed blocking channel, each blocking channel having a blocking pin inserted therein, each blocking channel originating and terminating within said first object, and each blocking channel intersecting at least one other channel within said first object, at least one blocking channel intersecting said locking channel;

said second object adapted to receive a portion of said first object, the surface of said first object where said first locking channel originates being adjacent to a surface of said second object in which a second locking channel originates, said second locking channel being aligned with said first locking channel so that one serves as an extension of the other when said objects are attached together;

a locking pin inserted into one of said locking channels, said pin being dimensioned such that it may freely move longitudinally within said locking channels but may not move laterally therewithin;

indirect force means for selectively moving said locking and blocking pins longitudinally within their respective locking and blocking channels, said force means making no direct physical contact with said pins, thereby allowing said locking pin to be positioned within said locking channels so that it simultaneously extends part way into said first object and part way into said second object when said second object is inserted into said first object and said locking channels are aligned, thus locking all lateral movement between the surfaces of said second object and first object, and thereby further allowing said blocking pins to be selectively positioned at the intersections of said channels, each of said blocking pins thus serving to block the movement of the locking or blocking pins within their respective channels; and a flexible cable having an end thereof attached to each of said objects, thereby allowing the locking of said objects to join said ends together.

4. A system for interlocking objects as defined in claim 3 wherein one of the ends of said flexible cable that is attached to one of said objects is one end of a single cable, the other end of which is attached to the other of said objects, thereby forming a continuous locked cable loop when said objects are joined together.

5. A method of manufacturing a locking puzzle, said puzzle comprising a geometrically shaped object into which a drawer is adapted to be fitted, said drawer being locked in its closed position unless a proper sequence of external directional force fields are applied to said geometrically shaped object, said method comprising the steps of:

(a) forming at least one locking channel inside of said geometrically shaped object that extends perpendicularly into a portion of said drawer relative to the direction that said drawer moves when opened;

(b) forming at least one blocking channel inside of said geometrically shaped object that intersects said locking channel;

(c) forming additional blocking channels, as desired, inside of said object, each of which intersects with at least one other channel within said object;

(d) inserting pins inside of each of said channels, said pins being dimensioned such that they may freely move longitudinally within said channels but may not move laterally therewithin; and (e) capping said channels so that said pins may not be removed therefrom.

6. A method of manufacturing a locking puzzle as defined in claim 5, wherein said channels within said geometrically shaped object intersect orthogonally with respect to each other.

7. A method of manufacturing a locking puzzle as defined in claim 6 wherein said geometrically shaped object is a pyramid sized to be easily hand held.

* * * * *